United States Patent [19]

Marshall et al.

[11] 4,388,969

[45] Jun. 21, 1983

[54] BOREHOLE PIPE SIDE ENTRY METHOD AND APPARATUS

[75] Inventors: Gailen Marshall, Houston; C. H. Myska, Sugar Land; Kenneth E. Smith, Houston, all of Tex.

[73] Assignee: NL Industries, Inc., New York, N.Y.

[21] Appl. No.: 211,614

[22] Filed: Dec. 1, 1980

[51] Int. Cl.[3] ..... E21B 17/00

[52] U.S. Cl. ..... 166/242; 174/47; 166/65 R; 166/385

[58] Field of Search ..... 166/65 R, 66, 385, 242; 175/45; 174/47; 277/188 R, 130, 131

[56] References Cited

U.S. PATENT DOCUMENTS

| | | | |
|---|---|---|---|
| 2,616,731 | 12/1952 | Osmun | 277/188 R |
| 2,690,713 | 10/1954 | Urmann et al. | 166/65 R |
| 3,196,948 | 7/1965 | Dye | 166/65 R |
| 4,200,297 | 4/1980 | Tricon | 166/65 R |

*Primary Examiner*—Stephen J. Novosad
*Assistant Examiner*—Joseph Falk
*Attorney, Agent, or Firm*—M. Lee Murrah; Donald L. Traut

[57] ABSTRACT

A side entry apparatus for use in a drill string permits a wireline to be connected with tool apparatus within the pipe and passed to the exterior of the pipe intermediate the ends of the drill string so that sections of pipe may be added to the drill string without interrupting the connection and resulting communication between the wireline and tool apparatus to which it is connected. The side entry apparatus includes a housing having an opening through the wall of the housing. A sealing element is arranged to be positioned about the wireline, between the wireline and the opening. A jacking mechanism is used to compress the sealing element and thereby move it into sealing contact about the wireline. A piston like member acts against the interior side of the sealing element and due to a differential pressure existing across the interior and exterior of the pipe string, moves against the sealing element to compress the sealing element against a retainer held in position by the jack mechanism, to expand the sealing element into further sealing contact with the wireline. The elements of the apparatus forming the sealing function are arranged to be assembled over the wireline after the wireline is passed through the side entry opening in the housing wall. This provides means to carry out a method of passing the wireline through the side entry opening without causing excessive wear on the line due to frictional and abrasive engagement with elements of the apparatus.

10 Claims, 6 Drawing Figures

BOREHOLE PIPE SIDE ENTRY METHOD AND APPARATUS

BACKGROUND OF THE INVENTION

The present invention relates to a borehole pipe side entry apparatus and method and more particularly pertains to a subassembly for coupling in a string of pipe to facilitate communication between the interior and exterior of the pipe string.

A common use for such a side entry apparatus involves providing wireline communication between the exterior and interior of a pipe string through a "packoff" to facilitate the use of electrically operated communication devices in a borehole drilling operation.

Wireline sealing apparatus for borehole drilling and workover operations include apparatus referred to as "packoff" units for sealingly engaging elements in communication with pressurized members. Such packoffs are often used in drilling apparatus where drilling mud is pumped under pressure down a drill stem to a mud motor which drives a drill bit. The mud motor drilling operation is particularly advantageous for a type of borehole construction referred to as controlled drilling wherein the drilling head is directionally controlled to drill both vertically and laterally. Similarly, various forms of packoffs have been found effective in facilitating certain aspects of controlled drilling.

Controlled drilling by its very definition generally requires directional survey information, since, in order to assure that the intended hole course and destination are achieved, it is necessary to know in which direction the hole is tending at any time. The bottom hole position with respect to the top hole position can be calculated from inclination and direction readings taken from a survey tool positioned in the borehole. Implementation of the survey tool normally requires the assembly of a packoff unit in the borehole apparatus.

Survey tools have been found to be useful for all forms of drilling, whether controlled or uncontrolled, since each form of drilling is greatly affected by forces which operate upon the drilling head and tend to randomly direct the course of the borehole away from that desired. Drilling variables such as hardness of formations, in particular, may cause the course to wander since the drill bit seeks the path of least resistance. Borehole courses are also affected by the reactive torque produced by a rotating drill bit, which torque operates upon the length of drill pipe and tends to produce a spiral hole. These forces continually affect the drilling operation and may cause deviations from the intended course of the borehole even when the drilling is theoretically controlled. It has thus been observed that surveying of the borehole in periodic increments during which the drilling is momentarily stopped and a survey package is lowered into the hole, is oftentimes inadequate for desired controlled drilling accuracy. Techniques have thus been developed for continuous monitoring of borehole construction facilitating "true control" in drilling.

In the past, drilling has been controlled either through "conventional" or "steering" procedures. Conventional directional drilling is generally a blind process in which a hole section is begun in a particular attitude, by the use of attitude deviation devices, and drilled for a time thereafter without knowledge of its instantaneous attitude. Steering, on the other hand, is a continuous process in which the attitude of the hole is continuously measured in order that course corrections may be made continuously rather than after a section of the hole has been drilled. Steering is most often a technique that is used in connection with the aforesaid mud motor drilling systems, in which the drill pipe remains stationary and the drill is rotated by a mud turbine, or moyno motor, operated by high pressure drilling mud supplied from the surface. Actual steering, or deflecting capability, is provided by a deflection tool known as a "bent sub," which is a substitute section of drill pipe formed with a bend therein and positioned at the lower end of the drill string near the drill bit. The primary determinant of the angle at which the drill bit addresses the formation is the degree of bend in the bent sub. In order to turn the hole, the entire drill string is merely rotated at the surface to point the bent sub in a different lateral direction.

There are several types of attitude indicating or steering tool instruments adapted for positioning in the borehole to provide directional information. These instruments include gyroscopic, inertial, magnetic, and gravitational types. The key to steering is communicating information from these tools to the surface, wherein the utilization of a packoff generally becomes necessary.

Attitude sensing devices operate generally in either a "drilling interrupt" or a "while drilling" mode. Generally speaking, only the devices employing electrical or magnetic sensing elements can be used in the "while drilling" mode because of the necessity of transmitting the data up the drill string to the surface. In some instances, the actual transmission from the steering tool is via acoustical transducers which alleviate cumbersome wirelines. However, in most instances where assured reliability and cost are factors for the surface to the downhole communication link, a wireline is preferable. Such wirelines interconnect steering tools inside the pressurized drill stem with instruments on the surface and outside the drill stem, necessitating a packoff at some point there between.

A conventional and commonly utilized prior art approach to steering through attitude sensing in the "while drilling" mode includes the communication wireline, wherein a cable is threaded through a packoff unit at the surface of the borehole near the end of the drill pipe and suspended through the center thereof. The wireline, in this manner, connects the steering tool and monitoring instruments at the surface. This approach, while reliable and effective in steering the drill bit to facilitate true "controlled" drilling, creates other serious procedural and mechanical problems which are directly related to the drilling operation. For example, a cable extending through the center of the drill pipe serves to complicate the requisite drilling hardware and the procedural aspect of adding additional sections of pipe which is inherently necessary as the borehole becomes deeper. Since the cable must be fed into the borehole through the drill stem from a cable reel, or drawworks, on the surface, that end of the wireline is not readily detachable. The only feasible way found to add additional drill pipe sections has been by pulling the steering tool and wireline back to the surface. This procedure requires a steering tool which may be readily locked and unlocked in position in the drill pipe. There is also the problem of sealing the area of interconnection where the wireline enters into the drill pipe, the drill pipe must be in sealed communication with the mud pump which forces mud into the hole under pressure for driving the mud motor and carrying off cuttings. Therefore, the wireline must enter the drill pipe through the aforesaid surface "packoff" which is expensive and further complicates the procedure of adding additional drill pipe.

The apparatus of the present invention is especially adapted for drilling with a steering system by providing for a wireline to be suspended along the outside of the drill stem and to enter and be secured therein through a side entry packoff somewhere in the drill string and oftentimes near the drilling head. In this manner, the present apparatus overcomes many of the disadvantages of the prior art by providing for a wireline communication link which enters the borehole through the upwardly moving mudflow which is egressing around the drill stem rather than through a surface packoff. It may be seen that the surface packoff is effectively replaced by a "downhole," side entry packoff, and the step of pulling the wireline and steering tool out of the hole to add additional drill stem may be eliminated. Since the outside wireline may still serve to connect the steering tool with the surface monitoring equipment, the apparatus of the present invention permits an effective "while drilling" steering mode without the major operational disadvantages generally associated therewith.

Two different methods are used for running a wireline through a side entry sub in controlled drilling operations involving a steering tool. One method involves positioning a side entry sub in the drill string near the mud motor. In this method, the wire line cable is run through the side entry sub and made up with the steering tool which in turn is then seated in the muleshoe sub for proper alignment with the bent sub. For this alignment technique, reference can be had to U.S. Pat. No. 3,718,194. The steering tool is then run into the hole as the drill string is made up and the wireline runs on the outside surface of the drill pipe. The advantage to this method is that the wireline is not pulled through the packoff and thus not subjected to wearing forces. However, it may be preferable to run the steering tool into the pipe from the surface. Thus, the second method involves placing the muleshoe sub in the drill string above the bent sub and then running the drill pipe string into the borehole for drilling. Then, when it is desired to "kick off" the hole or control the direction of drilling in a "while drilling" configuration, the steering tool is run in from the surface. This involves placing a side entry sub in a made up drill string at the surface when the drill and mud motor are at or near the bottom of the hole. The cable is passed through the side entry sub and the steering tool is then "made up" on the wireline. The tool is then pumped down the drill string by mud circulation through the pipe string until it seals in the muleshoe sub near the bottom end of the pipe string. This method thus requires running the wireline through the side entry sub to the full depth of the "kick off". In order to permit the cable to move through the side entry sub without excessive wear, the sealing arrangement must be accomplished after the steering tool is seated in the muleshoe. However, it is difficult with present side entry subs to carry out this second method of operation without causing excessive wear to the wireline cable.

Another application for the use of a pipe side entry apparatus pertains to the logging of a highly deviated borehole and in particular boreholes that approach a horizontal disposition with respect to the earth's surface. During drilling operations, various logging tools are run into the borehole to determine physical parameters of the formations being traversed. Typically, in such logging operations, the drill pipe is removed and the logging tool is lowered or dropped into the borehole on a wireline which provides an electrical conductor path to trasmit data being measured by the tool to the surface for recording. However, in boreholes deviated toward a horizontal disposition, gravity forces are not sufficient to permit lowering of the tool through the borehole. In such a situation, one method of logging the hole is to pump a logging tool through a drill pipe. An apparatus proposed for such a logging operation in rotary drilling operations is shown in U.S. Pat. No. 3,016,963 which describes a pump down logging device having a measuring wand passing through the eye of the drill bit. A recorder in the tool accumulates data which is retrieved to the surface when the pipe string is pulled. However, in directional drilling operations using a mud motor, the bottom of the drill pipe is closed for passage of a pump down logging tool of the type described above.

A means for effectively carrying out the logging operation described above with respect to highly deviated holes involves the use of a side entry sub much as in the manner described above relative to the second method of seating a directional drilling tool. In the logging operation, however, the motor and bit are not located in the pipe string and the lower end of the pipe string is open ended. Thus, the logging tool is capable of being pumped by mud circulation out the end of the drill pipe into open hole. Subsequently, the drill pipe string is raised, as sections of pipe are removed, and the logging tool is also raised while it is being operated to log the hole from the bottom up. This method of logging requires that the wireline be sufficiently packed off in the side entry to develop pumping pressure and at the same time, permit the wireline to pass through the side entry without excessive wear on the cable.

A prior art drill pipe side entry apparatus for use in drilling operations is shown in Base U.S. Pat. No. 4,062,551. The Base patent shows a side entry sub having a passageway for receiving a threaded plug. An opening in the plug receives the wireline cable and when the plug is secured in the passageway, a packing element below the plug is compressed to pack off the apparatus. One disadvantage of this device is that it does not provide for slipping the wireline through the apparatus in a logging operation. Also, it is not possible to assemble the device about the wireline after the wireline has been passed through the passageway in the sub. Tricon U.S. Pat. No. 4,200,297 shows a side entry packoff which has a wireline sealing member positioned in a passageway between a plug and an expansion member. By moving the expansion member toward the plug, the seal is compressed to seal the wireline in the passageway.

Van Wormer U.S. Pat. No. 2,355,342 shows apparatus for passing an electrical cable into a drill pipe through a sealed opening for operating a downhole electrical motor. This apparatus would be entirely ineffectual for the purposes of the present invention.

While these prior devices are generally concerned with the problem of providing a side entry communication between the interior and exterior of a drill pipe, they each offer disadvantages that do not permit an effective use of this concept, such as ineffective sealing, not permitting slippage of the wireline in certain applications, and most importantly, causing excessive wear to the wireline during the use of the side entry apparatus.

It is therefore an object of the present invention to provide a new and improved borehole pipe side entry apparatus for passing a tubular communications device from the exterior to the interior of a pipe string without causing excessive wear to the communications device, and at the same time, maintaining a pressure differential across the pipe string between its interior and exterior.

SUMMARY OF THE INVENTION

With this and other objects in view, the present invention contemplates a wellbore pipe side entry apparatus including a sub assembly housing for coupling in a pipe string. A recess portion in the housing partially encloses the side entry which includes a passageway through the wall of the housing. The passageway is sized to receive a tubular device such as a wireline for providing communication between the interior and exterior of the pipe string. A sealing arrangement in the passageway includes a fixed retainer on one side of the passageway and a movable retainer on the other side of the passageway with a seal element between the retainers and arranged to surround the tubular device. The movable retainer is responsive to differential pressures existing between the interior and exterior of the pipe string to move toward the fixed retainer and thereby compress the seal element around the tubular member.

The side entry device may provide an adjustment for the fixed retainer and further include a conveniently removable jack mechanism to permit rapid disassembly and reassembly of the removable portions of the side entry apparatus to replace portions thereof which are sized in accordance with the diameter of the tubular device passing therethrough. Another aspect of the invention utilizes a split configuration for the fixed and movable retainers as well as the jack mechanism so that these elements of the apparatus may be assembled about the tubular device after it is passed through the passageway.

Yet still another aspect of the invention is to avoid wear on the tubular device. An upset position on the outside surface of the housing provides an enlarged wall portion in which the recess is formed for accommodating the side entry passageway and associated apparatus. A beveled shoulder at the upper end of the upset forms a sloping transition of the housing surface between its normal pipe string diameter and the enlarged portion to facilitate non-binding movement of the upset portion through a borehole. An opening in the upper end of the upset provides a channel for receiving the tubular device along a plane substantially in line with the normal diameter of the pipe string and with the passageway through the wall of the housing. Still another aspect of the invention provides a roller surface in the recess to accommodate sliding movement of the tubular device as in the case of logging operation through the side entry apparatus.

DETAILED DESCRIPTION

Figure 1:
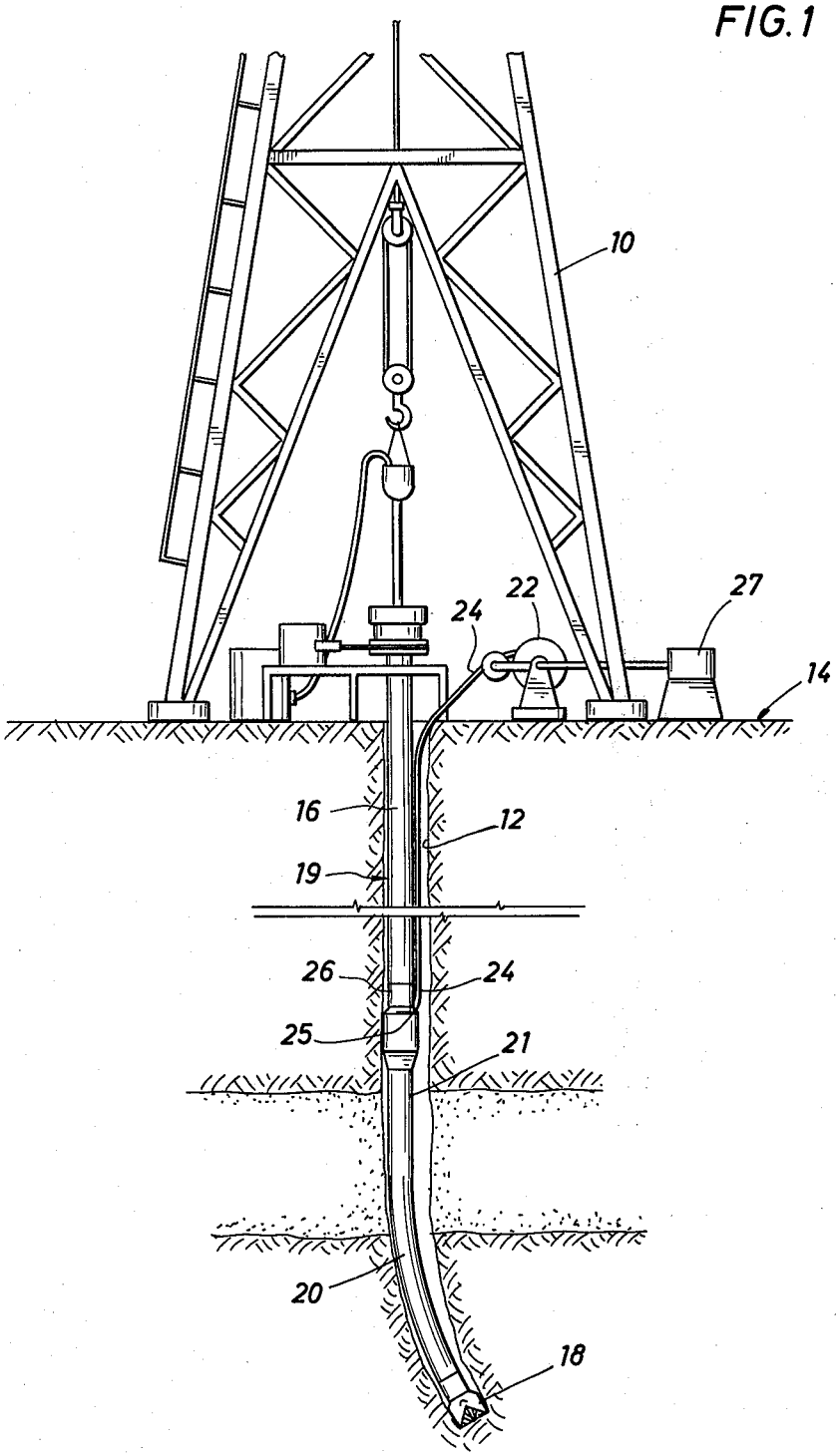
FIG. 1 is a fragmentary, cross sectional, side elevational view of a typically directionally drilled borehole and apparatus therefore including the side entry sub of the present invention.

Referring now to FIG. 1 of the drawings, there is shown a fragmentary, side-elevational, cross-sectional view of one type of drilling apparatus including a borehole depending therebeneath, with one embodiment of a method of and apparatus for drilling with a steering system provided therein. The drilling apparatus as schematically shown for purposes of illustration, includes a derrick structure 10 upstanding from a generally vertically formed borehole 12 which depends from a base surface 14 through a plurality of earth formations. The derrick structure 10 is shown in operational support of a drilling apparatus including a type of drilling apparatus generally referred to as the mud motor variety. In such apparatus, interconnected sections of drill pipe 16 are lowered into the borehole 12 for providing viscous mud under pressure to a hydraulic motor housed therein which drives a drilling head, or bit 18, therebelow. Only the drill bit 18 rotates, in the mud motor apparatus, rather than an entire drill string 19 as in the conventional rotary drilling systems. The mud existing from the drill bit 18 also picks up the borehole cuttings and carries them to the surface of the borehole. A trench 23 is provided at the surface 14 for receiving the mud egressing from the borehole for recirculation. It is in this particular system of drilling that the methods and apparatus of the present invention are particularly applicable.

The drill string 19 is made up of sections of drill pipe 16 which are securely assembled and interconnected one to the other at the surface 14 before lowering into the borehole 12. The standard drill string pipe sections are generally linear, tubular structures with interconnected fittings on both ends. Certain pipe sections may, however, have specific modified configurations for providing preselected boring or operational characteristics. It may be seen that such a modified pipe section is provided in a portion of the drill string 19 comprising the angled substitute section 20, commonly referred to as the "bent sub." The bent sub is generally positioned above the drill bit 18 for providing a deflection plane which causes the drill bit to bore downwardly through, and laterally from, the theoretically vertical borehole axis. In order to control the borehole course resulting from the bent sub, means are provided for monitoring the angle of the borehole. Such means, as discussed in the background of the invention above, are commonly referred to as steering tools because they provide a steering type readout at the surface 14 of the ongoing borehole extension. A steering type is positioned preferably in the lower end of the drill string 19 in the general vicinity of the drilling head, as will be discussed in more detail below. It is the requisite function of communicating with the steering tool 21 from the surface 14 that provides one basis for the methods and apparatus of the present invention.

Still referring to FIG. 1, a cable reel, 22, is shown for feeding a "surface to steering tool" communication wireline, or cable 24, into the borehole. The surface end of the cable 24 is connected to an instrument package 27 for receiving and translating the desired cable signals from the borehole 12. The lower end of the cable 24 is connected to the steering tool 21 in the manner to be discussed in more detail below. However, unlike many prior art communication links between steering tools and surface equipment, the cable 24 of the present invention is provided along the outside of the drill pipe 16 rather than suspended through the center thereof. Provisions are made in the particular embodiment of the invention illustrated in FIG. 1 for the cable 24 to enter the drill pipe 16 near the steering tool 21 through the sidewall of a specially adapted drill pipe section. An aperture 25 is formed along the sidewall of a portion of the pipe section 26 hereinafter referred to as a side entry sub. The aperture 25 is suitable constructed to permit the cable 24 to be received therein condition for extending through the side entry sub 26 to the steering tool 21 secured therein. In this advantageous manner, the cable 24 above the side entry sub 26 may continually lie undisturbed in the borehole 12 while additional sections of pipe 16 are added at the surface 14. Yet in conventional functional respects, the cable 24 provides the requisite communication link between surface and steering tool while utilizing the otherwise conventional steering apparatus of the wireline variety as described herein.

Figure 4:
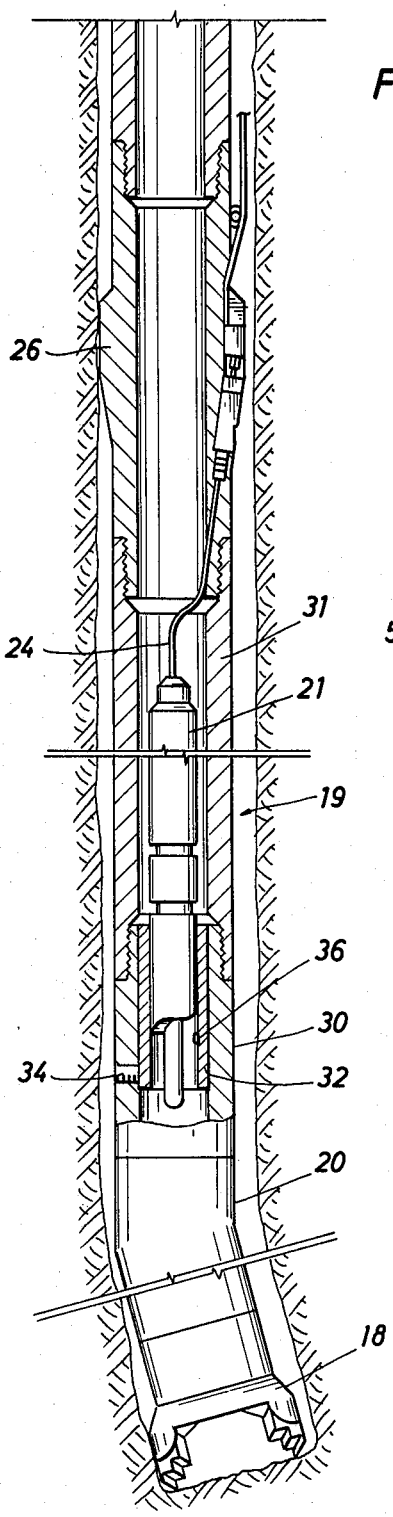
FIG. 4 is an enlarged, side-elevational, cross sectioned fragmentary view of the section of drill pipe in the borehole of FIG. 1 illustrating the side entry sub in relation to a steering tool.

Referring now to FIG. 4, there is shown one embodiment of a side entry packoff assembled in position in a section of drill pipe, as will be discussed in detail below. It may also be seen that suitable apparatus is provided for assuring that the rotational position of the steering tool 21 and side entry packoff positioned thereabove is controllably secured. Above the bent sub 20, the drill string 19 thus preferably includes a mule shoe orienting sub 30 and non-magnetic drill collar 31. The steering tool 21 is shown positioned within the interior of the drill collar 31 and is connected at its upper end to the cable 24 which extends up, through, and out the side entry sub 26 thereabove. The cable 24 carries signals generated in the tool 21 to the surface 14 for translation in the instrument package 27.

Mule shoe orienting sub 30 generally includes a mule shoe sleeve 32 positioned within its interior bore in a predetermined orientation. Sleeve 32 is held in the predetermined orientation with the sub by means of a screw, or the like, 34, extending through the sidewall of the sub 30. Mule shoe sleeve 32 has a key 36 positioned in its sidewall extending inwardly into the interior bore. The mule shoe sleeve and its key are normally aligned with respect to the deflection plane of the bent sub. This predetermined alignment of the mule shoe with respect to the deflection plane of the bent sub is convenient for purposes of determining the position of the drill bit 18 with respect to the surface indications of hole deflection and providing compensating changes therein, although other alignment techniques could also be used. Mule shoe sleeve 32 has longitudinal slots (not shown) formed therein which provide a mud circulating bypass through the sleeve when the tool 21 is positioned therein. For a further detailed disclosure of a typical assembly of such a tool 21 in the aforedescribed apparatus, reference may be had to the aforementioned U.S. Pat. No. 3,718,194.

Figure 2:
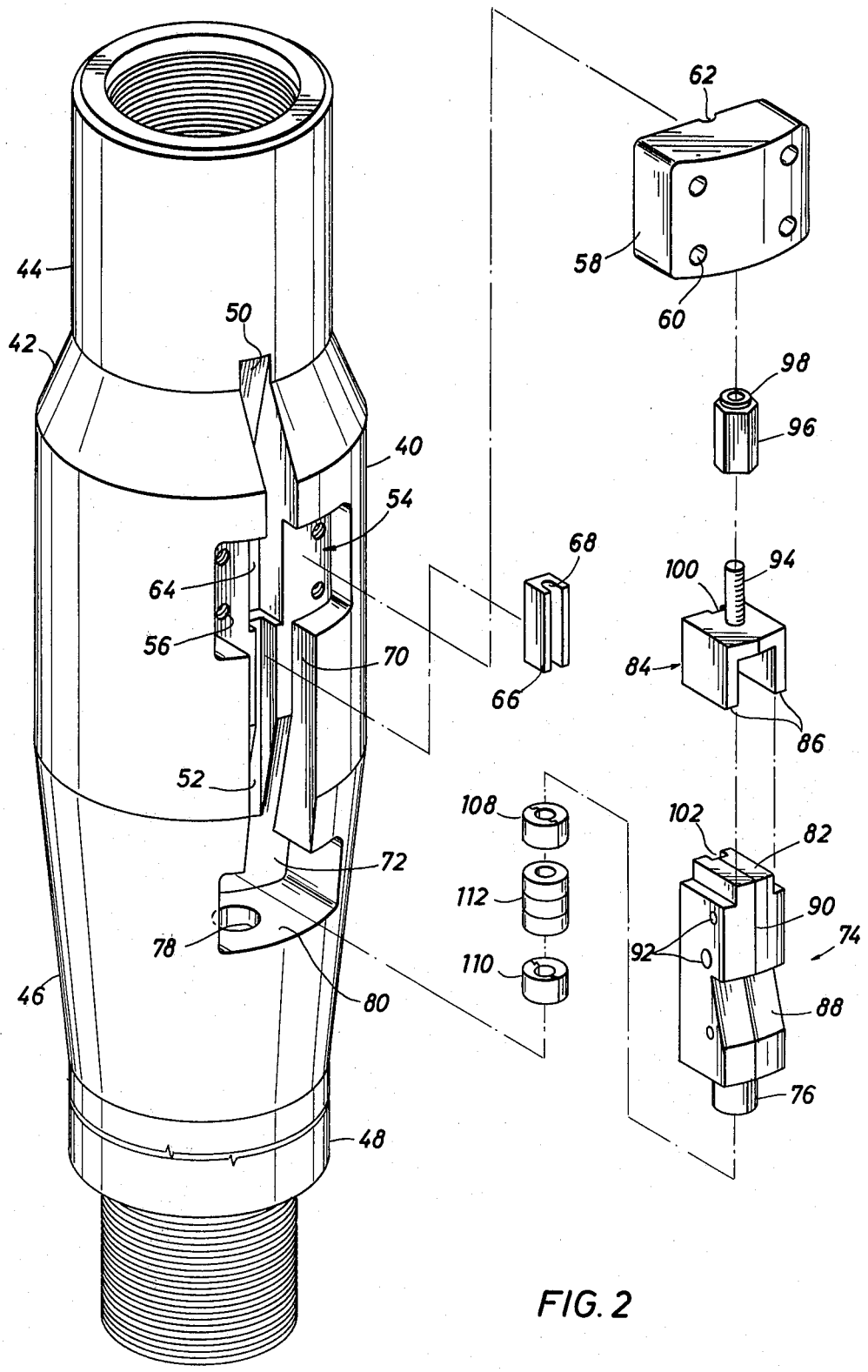
FIG. 2 is a perspective exploded view of a side entry sub in accordance with the present invention.

Referring next to FIG. 2 of the drawings, the side entry sub 26 is shown in perspective with the assembly parts to be installed in the recess shown in exploded position relative to the sub. The recess is formed in an upset portion generally noted by the reference 40 having an upper sloping or beveled shoulder portion 42 expanding outwardly between a normal diameter pipe portion 44 and the upset portion 40. A lower sloping or beveled shoulder portion 46 recedes inwardly on a more gentle slope to the normal diameter pipe portion 48 below the side entry. A downward sloping channeled pathway 50 is formed in the upset portion extending from just above the beveled shoulder 44 to a flat channeled pathway portion 52 in the bottom of the recess. These channels, or pathways 50, 52, are shown extending through the length of the mechanism and its parts more clearly in FIG. 5. Again referring to FIG. 2, an upper rectangular shaped opening 52 is formed in the recess and has tapped holes 56 in its inner wall to accommodate bolts for holding a clamp plate 58, also having holes 60 to accommodate such bolts. A groove 62 is formed on the bottom surface of the clamp plate to form part of the pathway 52 through the apparatus. A deeper recessed portion 64 is formed in the bottom of opening 54 to receive a channel shaped insert 66. Insert 66 is sized in its interior channel portion 68 to more snugly fit around the wireline 24 passing through the apparatus. In this respect, the insert is changeable to accommodate variations in the size of the wireline being used. The recess next has a more narrow cut out portion 70 which extends between opening 54 and a lower rectangular shaped opening 72.

Figure 3:
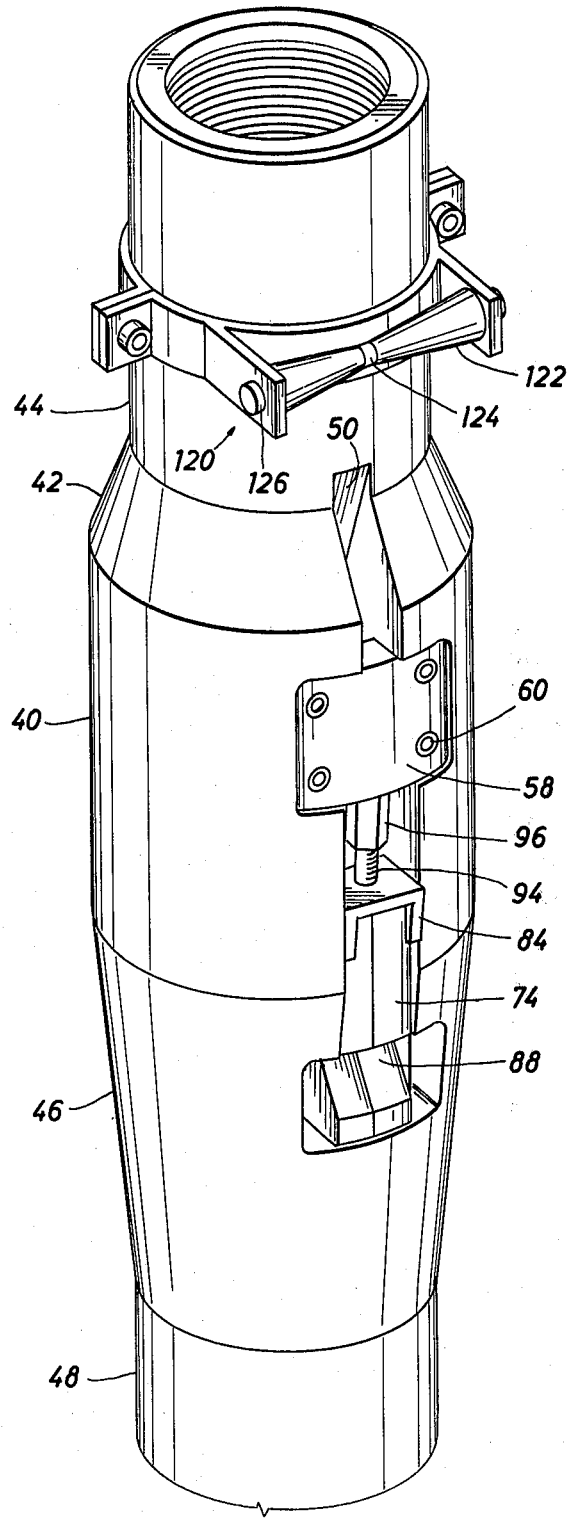
FIG. 3 is a perspective view of a portion of the side entry sub of FIG. 2 in assembly.

The openings 70 and 72 receive a packer or jack 74 having a lower projecting plunger 76 sized for reception within a hole 78, extending through the lower end wall 80 of the opening 72. Parallel cut out portions on the upper end of the packer 74 form an upwardly projecting nose portion 82 on the packer. A notched portion 88 on the outer face of the packer provides a means to stroke the packer when disassembling the apparatus. The packer is made in two half sections dividing the packer down its longitudinal middle as shown by the line 90. Holes 92 in the side wall portions of each half of the packer provide dowell and screw means to hold the halves in assembly. A jack clamp 84 has parallel extending side walls 86 forming a bifuscated element which matingly fits about the nose portion 82 in assembly as shown in FIG. 3. A threaded stud 94 extends upwardly from the jack clamp 84. An adjusting nut 96 having flats formed thereon to accommodate handling with a wrench is threaded in an interior bore to fit about the lug 94. The adjusting nut has a boss 98 formed on its upper end which is sized to fit within a mating recess 99 (FIG. 5) formed on the lower end of clamp plate 58. The boss 98 and mating recess hold the nut 96 in alignment between the clamp 84 and clamp plate 58 and permit rotation of nut 96 on the lug 94.

It is noted that channel cut outs are showing at 100 and 102 on the upper ends of packer clamp 84 and packer 74 respectively. This forms part of the pathway 52 that extends the length of the packer assembly described above and communicates the channel 50 at the upper end of the upset with the hole 78 on the lower end of the recess portion in the upset.

Figure 5:
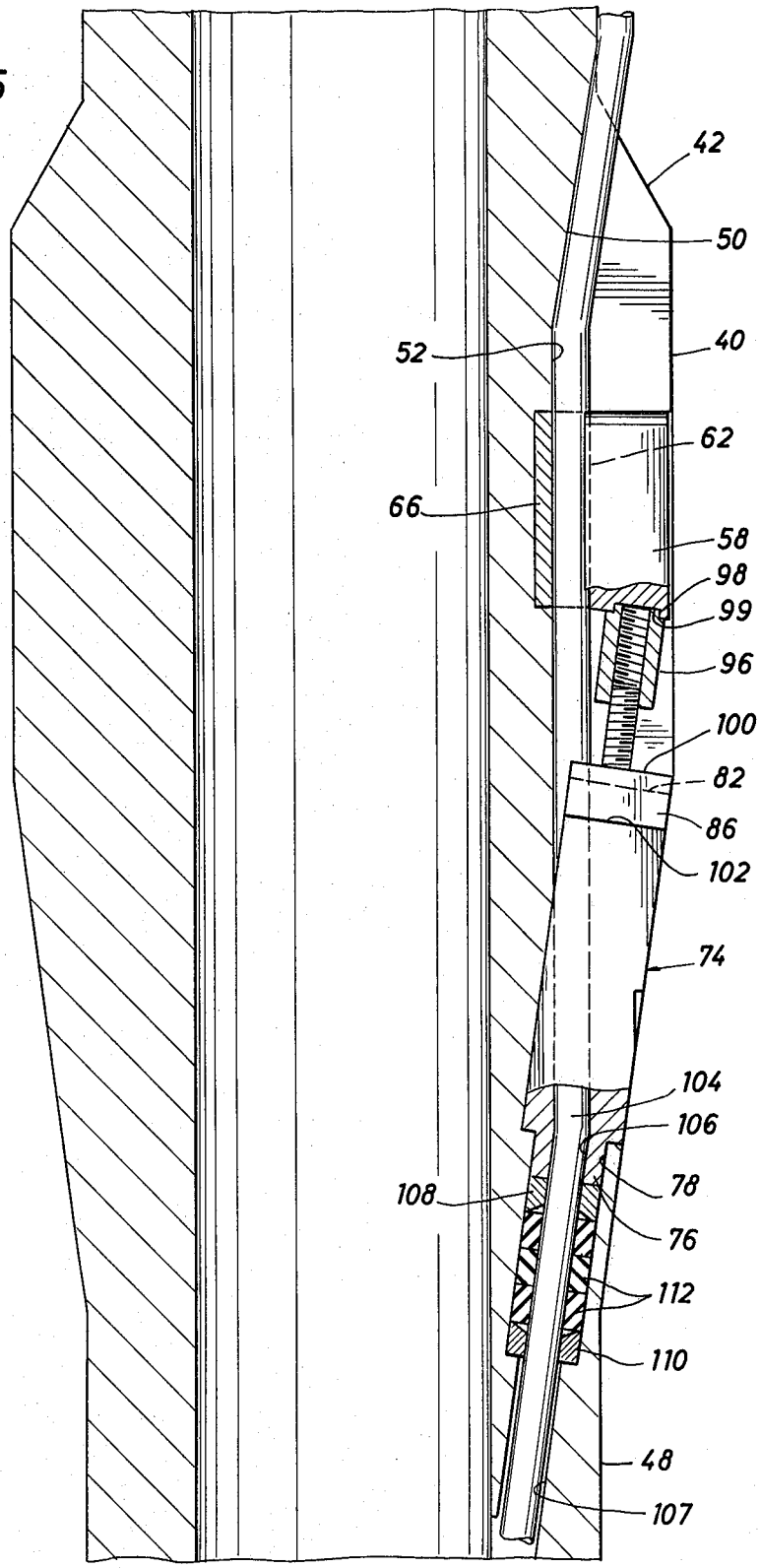
FIG. 5 is a cross sectional view of a packer mechanism positioned in a recessed portion of the side entry sub and showing a pathway for passing a wireline through the sub shown in FIGS. 2 and 3; and, FIG. 6 is a cross sectional view of an alternative arrangement for a cable guiding device for use with the side entry sub in logging operations.

Referring next to FIG. 5 of the drawings, the packer assembly is shown in cross section positioned in the recess on the upset 40 and shows the angular relation of the parts in assembly. The pathways 50 and 52 together with adjacent channels and grooves in the assembly parts form a longitudinal passage extending from the upper end of the upset to the hole 78. This passage is formed by channel 50, channel 52, channel position 68 in insert 66, channel cut outs 100 and 102 in the packer clamp and packer respectively and a semicircular hole 104 formed in the inner race of each half of the packer, which when assembled continues the passage throughout the assembly. A slight angle is formed in the semicircular holes 104 to form an angle at 106 in the passage as it passes through the packer 74 and form a downwardly sloping passageway 70. This angle is milled to have a rounded edge so as to present a surface which will not excessively wear the wireline cable 24 passing through the apparatus. The split packer permits ease in rounding this angle during manufacture.

The packer assembly is completed by upper and lower retainers 108 and 110 which are sized to fit within the hole 78. These retainers are made of a split ring configuration (see FIG. 2) to permit their being assembled on the cable 24 after it has been passed through the aforementioned passageways and hole 78. In assembly, a packing material 112 such as a cord type graphite embedded packing materials is wrapped around cable 24 and positioned in assembly between the upper and lower retainers 108 and 110 respectively. Both the upper and lower retainers are champhered on their ends facing the packing material as shown on lower retainer 110 in FIG. 2.

Figure 6:
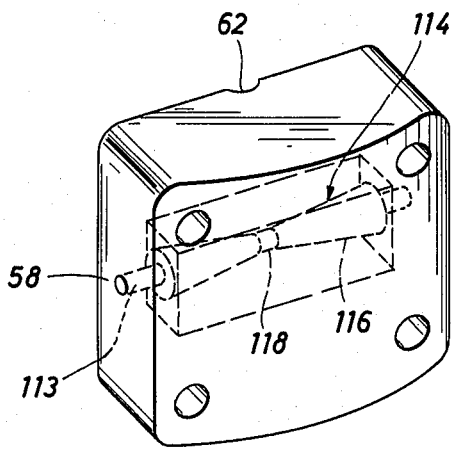

Referring now to FIG. 6 of the drawings, an alternative clamp plate 58 is shown having a roller 114 mounted on an axle 113 for rotative movement relative to the clamp plate. The roller has mirror image tapered portions 116 which meet in a center void portion 118 to form a roller notch to accommodate rolling movement of a cable 24 through the packer assembly.

Similarly FIG. 3 shows a roller guide 120 mounted on the normal diameter portion 44 of the sub above the side entry upset portion 40. The roller guide has tapered roller portions 122 which are rounded over their inner ends to form a smooth notch 124 between the roller ends. An axle 126 holes the rollers for rotation.

In the operation of the apparatus described above, the side entry sub is used in a steering tool operation in different methods as described in the "Background of the Invention." When the sub 26 is assembled just above the bent sub as shown in FIG. 4, the tool string up to the side entry sub 26 is first made up and started in the hole. Next the cable head is removed from the cable 24 and upper and lower retainer bushings 108, 110 are threaded on the cable. (If the retainer bushings are split as shown in FIG. 2, then this step may be performed when the packing material is placed on the cable.) The wireline is then passed through the opening 78 at the lower end of the recess 72 and through the passage 107 extending through the inner wall of the sub and thence out the lower pin end of the sub. The cable head is then made up on the tool to be run such as a steering tool 21. The tool is then run into the muleshoe sub 30 and seated in the muleshoe. Next the side entry sub is made up into the drill string. After slacking the wireline the desired amount, packing is positioned between the retainers and packing and retainers are positioned in hole 78. The split packer 74 is then assembled on the wireline and secured by screws and dowells. The plunger 76 is inserted on top of the retainers and packing and pushes the retainers and packing into position in the hole 78. The clamp plate 58 and proper sized insert 66 are assembled by bolts to the assembly. The packing clamp 84 is then placed over nose portion 82 of packer 84 with boss and 98 of nut 96 positioned in recess 99 on the clamp plate 58. A wrench is used to run the nut 96 up against the clamp plate 58 to run the packer plunger 76 down against the retainer 108 to seal the retainers 108, 110 and intermediate packing 112 in the hole 78. The roller guide 120 is removed from the pipe and pipe sections are then added as the tool string is run in the hole.

The alternative method used in logging and when the side entry sub is positioned at the top of the pipe string in steering operations is as follows: As to steering tool operations, the pipe string is broken at the surface when the hole is ready to be "kicked out." The cable is threaded through the side entry sub as previously described and the tool is made up in the string. The cable is also threaded through the roller guide 120 which is placed on the sub above the upset. The tool is then run to the bottom of the string as cable is unreeled from the drum 22 at the surface. When the tool is seated, the retainers and packing are installed in the line and the packer assembled in the sub as described previously. The steering operation is then ready to begin.

In a logging operation, open ended pipe is run into the hole to a point spaced above the bottom of the interval to be logged, at least as long as the interval to be logged. The pipe string is broken for placement of the side entry sub in the string. The cable is threaded through the hole 78 and passage way 107 until it extends out the bottom of the sub whereupon the logging tool or the like is made up on the cable. The sub 26 is then installed in the pipe string. The packing and inserts are then made up on the cable as well as the packer itself as previously described. The alternative clamp plate 58 shown in FIG. 6 is installed in the packer assembly to facilitate movement of the cable 24 after the packer is assembled. Mud is then circulated into the pipe string above the tool to pump the tool down the pipe string at least a distance equivalent to the length of interval to be logged. Pipe is then added to the string to lower the string to a point just above the bottom of the interval to be logged. Circulation is again begun to pump the tool down the string until it exits the lower end of the pipe string. Pipe is then removed from the pipe string at the surface and as this is done, the wireline cable is retracted at the surface to pull the logging tool up the hole and log the hole. When the interval has been logged, the logging tool is retrieved to the surface and the side entry sub is broken out.

Referring now to the operation just described and FIGS. 2 and 5 of the drawings showing the retainers 108, 110 with champhered inner edges, when the retainers are positioned in the hole 78 about the packing 112 during an operation when a pressure differential exists across the interior and exterior of the side entry sub, the differential which normally shows a greater pressure on the interior of the pipe string, especially during mud circulation, causes the lower retainer 110 to move upwardly toward upper retainer 108. Retainer 108, however, is restrained from movement by packer plunger 76 which, in turn, is held in place by the packer assembly. Thus the upward movement of retainer 110 compresses packing material 112 about the cable 24 with the champhered edges of retainers 108 and 110 concertrating the packing about the cable. The graphite packing or the like thus seals about the cable and at the same time, forms a wiping surface that permits the cable to be moved through the sub as in the logging operation.

While particular embodiments of the present invention have been shown and described, it is apparent that changes and modifications may be made without departing from this invention in its broader aspects. For example, while the invention has been described for use with particular wireline cable operations, it is apparent that any tubular member which it is desired to pass through the side of a pipe string and seal off therethrough, falls within the spirit of this invention, therefore, the aim in the appended claims is to cover all such changes and modifications as fall within the true spirit and scope of this invention.

What is claimed is:

1. An apparatus for facilitating entry of a small diameter tubular member from the exterior to the interior of a pipe string in a borehole, comprising a housing arranged for coupling in said pipe string; said housing having a longitudinal bore communicating with the bore of said pipe string;

a means forming a recess in the wall of said housing;

a passage means in said recess means and communicating between the interior and exterior of said housing for passing said tubular means therethrough;

a seal means arranged in said passage means for encircling said tubular member;

a first retainer means on one side of said passage means for fixedly retaining one side of said seal means, said retainer means being movable between fixed positions;

a second retainer means on the other side of said seal means; and an adjustable jack means positioned in said recess for moving said first retainer means between fixed positions.

2. The apparatus of claim 1 and further including clamp means in said recess means having an insert removable mounted in said recess to facilitate changing said clamp insert to accommodate diameter variations in said tubular member, said clamp means holding said wireline like device against longitudinal movement in said recess means.

3. The apparatus of claim 2 and further including an opening in the upper end of said upset portion connecting the exterior wall of said housing above the upset portion with the interior of said recess means and substantially longitudinally aligned with said passage means.

4. The apparatus of claim 3 and further including roller means in said recess means for facilitating movement of said tubular member through said opening and passage means.

5. The apparatus of claim 1 wherein said first and second retainer means are changeable to accommodate variations in the diameter of said tubular member.

6. The apparatus of claim 1 wherein said passage means is substantially straight and slopingly arranged in said housing for connecting the lower end of said recess means with the interior of said pipe string.

7. The apparatus of claim 1 wherein said housing is a pipe string sub assembly having box and pin ends for connection in said pipe string.

8. The apparatus of claim 1 and further including an upset portion formed on said housing to provide a thick wall portion on said housing, said recess means being formed in said upset portion, said upset portion being arranged with sloping shoulder portions at each end of said upset portion to form a smooth transition from a regular pipe diameter portion to an enlarged diameter portion forming said upset portion.

9. The apparatus of claim 1 wherein said adjustable jack means includes an adjustable jack mechanism for permitting longitudinal adjustment of a means within said recess means for fixing the position of said first retainer means.

10. The apparatus of claim 1 wherein said second retainer means is movable in response to a pressure differential between the interior and exterior of said housing.

* * * * *